United States Patent [19]

Yamada et al.

[11] Patent Number: 5,035,413

[45] Date of Patent: Jul. 30, 1991

[54] PRINTER WITH AN INITIAL SHEET-SETTING FUNCTION

[75] Inventors: Keiko Yamada, Aichi; Mitsunobu Suda, Nagoya; Ichirou Kawashima, Iwatsuki; Nobuhiro Kitagawa, Yokohama, all of Japan

[73] Assignee: Brother Kogyo Kabushiki Kaisha, Aichi, Japan

[21] Appl. No.: 455,136

[22] Filed: Dec. 22, 1989

Related U.S. Application Data

[63] Continuation-in-part of Ser. No. 257,020, Oct. 13, 1988, abandoned.

[30] Foreign Application Priority Data

Oct. 16, 1987 [JP] Japan ..... 62-262511

[51] Int. Cl.[5] ..... B65H 3/44

[52] U.S. Cl. ..... 271/9; 271/228; 271/265; 271/902; 400/605; 400/624; 400/629

[58] Field of Search ..... 271/9, 110, 111, 225, 271/258, 259, 902, 265, 227, 228; 400/605, 624, 625, 629

[56] References Cited

U.S. PATENT DOCUMENTS 4,362,409 12/1982 Endo et al. .
4,407,597 10/1983 Kapp .
4,438,915 3/1984 Akamatsu et al. .
4,565,462 1/1986 Yamamoto et al. .
4,652,161 3/1987 Crean et al. .
4,684,276 8/1987 Frei et al. ..... 271/227 X
4,761,087 8/1988 Ward et al. .
4,929,105 5/1990 Hirayama et al. ..... 271/225 X

FOREIGN PATENT DOCUMENTS 0183413 11/1984 European Pat. Off. .
0279530 8/1988 European Pat. Off. .
59-16774 1/1984 Japan .
154865 7/1986 Japan ..... 400/624
167158 7/1987 Japan ..... 271/902
235633 9/1987 Japan ..... 400/624

*Primary Examiner*—Robert P. Olszewski
*Assistant Examiner*—Boris Milef
*Attorney, Agent, or Firm*—Oliff & Berridge

[57] ABSTRACT

The printer drives the sheet feeding mechanism in response to the initial sheet-setting command and both the first sensor's and the second sensor's detection of no sheet, first forward until the second sheet sensor detects no sheet, then backward until the second sheet sensor detects no sheet, and finally forward the predetermined distance. The paper is neither caught nor crumpled near the exit of the first sheet supplier when the paper is fed backward.

6 Claims, 5 Drawing Sheets

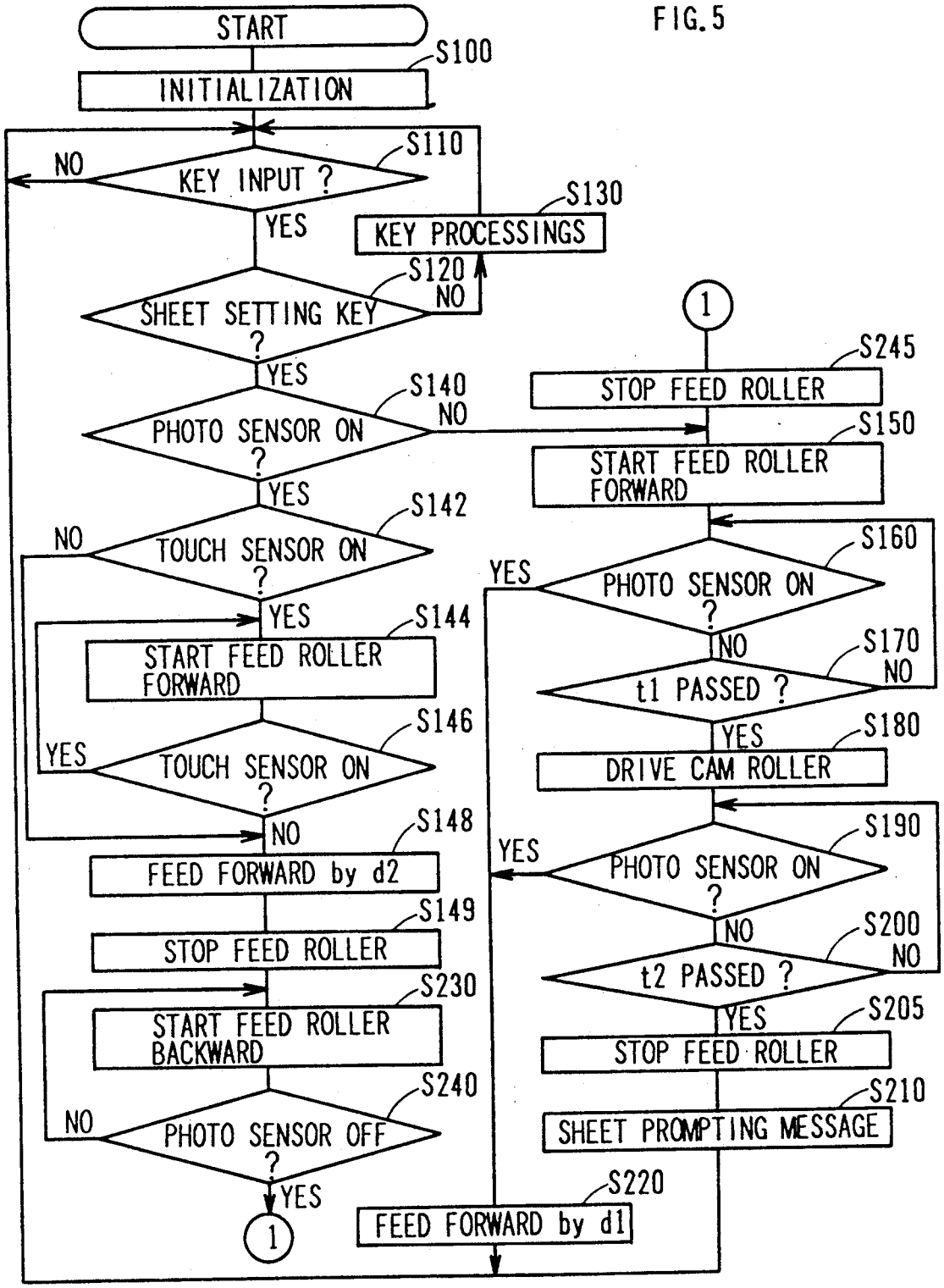
FIG. 5
START
S100
INITIALIZATION
S110
KEY INPUT ?
NO
YES
S130
KEY PROCESSINGS
S120
SHEET SETTING KEY ?
NO
YES
S140
PHOTO SENSOR ON ?
NO
YES
S142
TOUCH SENSOR ON ?
NO
YES
S144
START FEED ROLLER FORWARD
S146
TOUCH SENSOR ON ?
YES
NO
S148
FEED FORWARD by d2
S149
STOP FEED ROLLER
S230
START FEED ROLLER BACKWARD
S240
PHOTO SENSOR OFF ?
NO
YES
1
1
S245
STOP FEED ROLLER
S150
START FEED ROLLER FORWARD
S160
PHOTO SENSOR ON ?
YES
NO
S170
t1 PASSED ?
NO
YES
S180
DRIVE CAM ROLLER
S190
PHOTO SENSOR ON ?
YES
NO
S200
t2 PASSED ?
NO
YES
S205
STOP FEED ROLLER
S210
SHEET PROMPTING MESSAGE
S220
FEED FORWARD by d1

PRINTER WITH AN INITIAL SHEET-SETTING FUNCTION

This application is a Continuation-in-Part of U.S. patent application Ser. No. 07/257,020 filed Oct. 13, 1988, now abandoned.

BACKGROUND OF THE INVENTION

This invention relates to a printer that prints on separate, cut sheets of paper. The printer may be separate from its data source, such as a computer, or may be installed within a machine such as a word processor.

Some printers, with either an automatic sheet-loading mechanism or a manual loading mechanism, have an initial sheet-setting function that automatically sets a sheet of paper at a predetermined initial printing position. For example, when an appropriate key (initial sheet-setting key) is pressed, a sheet on a sheet stack is fed forward into a printing mechanism to bring a preset top-of-page position at the printing head. A photo-sensor in the sheet path of a sheet loading mechanism detects the leading edge of the sheet and the sheet is fed a predetermined distance after detection. This assures a uniform starting position for printing on every sheet.

A problem occurs, however, when a sheet is already loaded in the printing mechanism. When a sheet is skewed in the printing mechanism, the operator releases pressure rollers from the sheet and manually aligns the leading and trailing edges of the sheet to set it at right angles. In this case, since the sensor cannot detect the leading edge of the sheet any more when the initial sheet-setting key is operated, the initial sheet-setting is not operated, instead the already loaded sheet is discharged from the printing mechanism. This makes the operator's sheet alignment futile. Therefore, after aligning the sheet, a special initial sheet-setting is required by, for example, manually rotating a platen or carefully operating a line feed switch. These operations are tedious, time consuming and, often, inaccurate.

SUMMARY OF THE INVENTION

An object of the invention is to provide a printer with an initial sheet-setting function in which the paper is neither caught nor crumpled near the exit of the first sheet supplier when the paper is fed backward.

Another object of the invention is to provide a printer with an initial sheet- setting function in which a switch for choosing one between a manual paper-feed and an automatic paper-feed from the first sheet supplier is not necessary.

Another object of the invention is to provide a printer with an initial sheet-setting function in which absence of the paper in the first sheet supplier can be detected without a specific sensor.

The printer according to the invention comprises: sheet feeding means for feeding a sheet forward to and backward from a printing position; a first sheet sensor, provided before the printing position, for detecting the sheet; an initial sheet-setting controller, in response to the external initial sheet-setting command and the first sheet sensor's initial detection of no sheet, for driving the feeding means to feed the sheet forward a predetermined distance after the first sheet sensor first detects the sheet, and wherein said initial sheet-setting controller, in response to the external initial sheet-setting command and the first sheet sensor's initial detection of the sheet drives the sheet feeding means to feed the sheet backward until the sheet sensor first detects no sheet and then to feed the sheet forward the predetermined distance; a sheet supplier for holding a plurality of separate sheets, and in response to the external sheet-setting command, for supplying one of the sheets to a printing section of the printer; wherein the initial sheet-setting controller sends, in response to the initial sheet-setting command, the sheet-demanding command to the sheet supplier when the first sheet sensor detects no sheet, followed by feeding the sheet forward the predetermined distance after the first sheet sensor first detects the sheet; said sheet supplier further includes a second sheet sensor at a sheet exit of the sheet supplier; and the initial sheet-setting controller drives the sheet feeding means, in response to the initial sheet-setting command and both the first sensor's and the second sensor's detection of the sheet, first forward until the second sheet sensor detects no sheet, then backward until the first sensor detects no sheet, and finally forward the predetermined distance.

BRIEF EXPLANATION OF THE DRAWINGS

FIG. 5 is a flowchart of an initial sheet-setting routine executed by the control section

DETAILED DESCRIPTION OF THE PREFERRED EMBODIMENT

Figure 1:
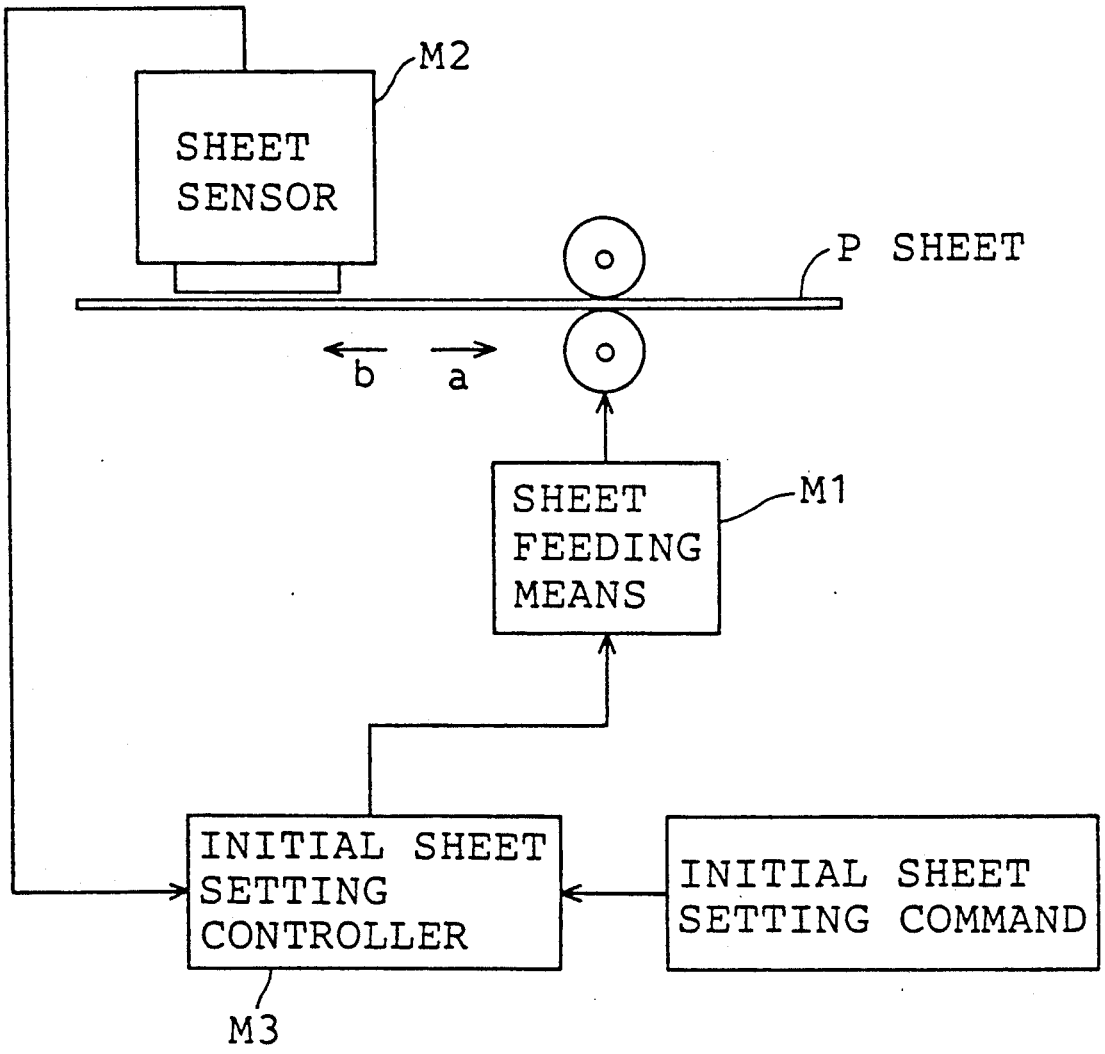
FIG. 1 is a diagram of the conceptual structure of the invention.
Figure 2:
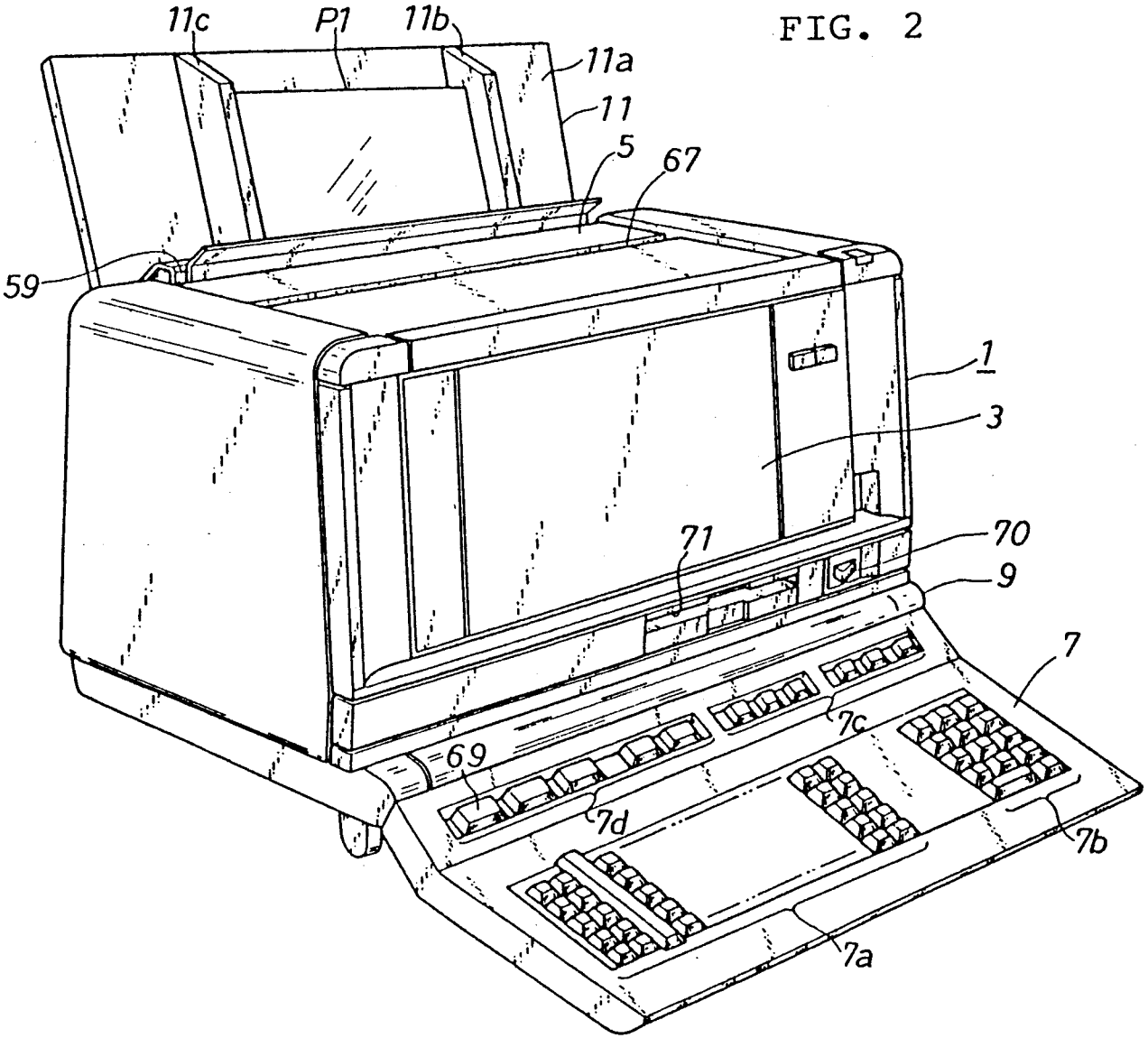
FIG. 2 is a perspective view of a word processor implementing the printer of the invention.

An embodiment of the invention is explained with a word processor shown in FIG. 2. The body 1 of the word processor includes a liquid-crystal display (LCD) 3 in the front and a printer 5 in the back. A keyboard 7 is connected to the body 1 via a hinge 9 so it can be turned up to face the LCD 3 when the word processor is not used. The power switch 70 and a floppy disk unit 71 are provided on the body 1 under the LCD 3. A control section (not shown in FIG. 2) including a microcomputer for performing the word processor functions is installed in the body 1.

Figure 3:
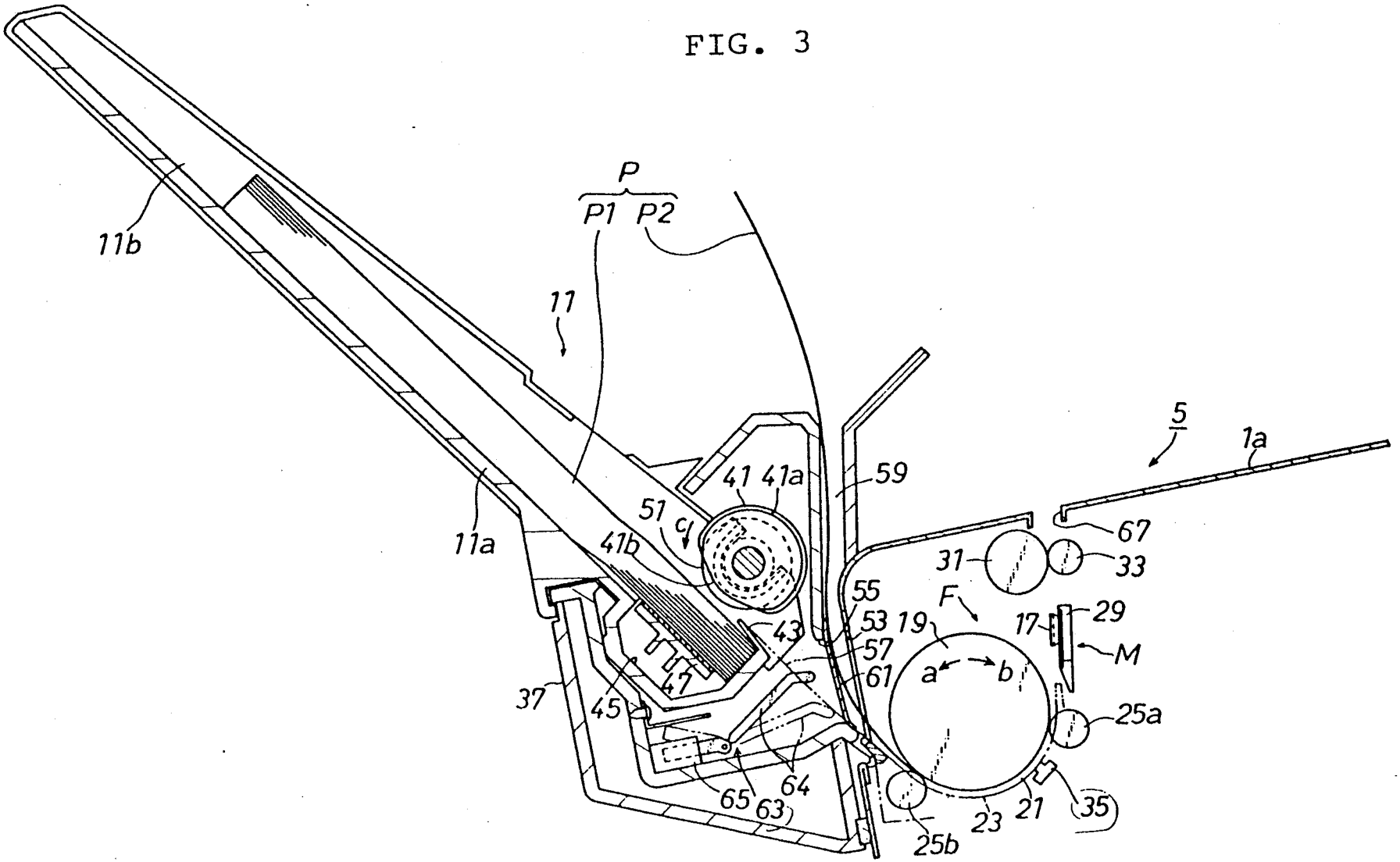
FIG. 3 is a sectional view of a sheet loading mechanism of the printer of the word processor.

The printer 5 is of the dot-matrix type and uses a thermal head with many tiny heater elements. As shown in FIG. 3, the sheet loading mechanism of the printer 5 includes a sheet feeding mechanism F in a body frame 1*a* and a cut-sheet supplier 11 attached at the back of the frame 1*a*. The sheet feeding mechanism F includes a feed roller 19 that a feed roller motor 27 (FIG. 4) drives forward (a) and backward (b). Around the feed roller 19 is a sheet guide 23, making a sheet path 21 between them. Small front and rear free rollers 25*a* and 25*b* contact the feed roller 19 to hold a sheet P.

Above the feed roller 19 is a flat platen 17 and a thermal printing head 29 at a printing position M. A printing head motor 30 (FIG. 4) drives the printing head 29, which prints characters on the sheet P via an ink ribbon (not shown), horizontally along the platen 17. Further above the printing position M are provided a pull-out roller 31 that cooperates with the feed roller 19 and a pinch roller 33 that contacts the pull-out roller 31 only when the sheet P is discharged from the printer 5. The sheet P is discharged from an exit 67 in the frame 1*a*.

A photo-sensitive sheet sensor 35 is on the sheet guide 23 between the small rollers 25*a* and 25*b* to detect the sheet P in the sheet path 21.

The cut-sheet supplier 11 includes a frame 37 attached at the back of the body 1 and a sheet bed 11*a* slanting back and up from the frame 37. Sheets of paper P1 are stacked on the sheet bed 11*a*, restricted by a pair of lateral sheet guides 11*b* and 11*c* (FIG. 2). Over the lower end of the sheet bed 11*a* is a cam roller 41 having a larger, rounder arc 41*a* and a smaller, flatter arc 41*b*. A sheet separator 43 is at each side of the lower end of the sheet bed 11*a* for separating the uppermost sheet from the second sheet. A cavity 45 at the lower end of the sheet bed 11*a* holds a thrust plate 47 which pushes the stacked sheets P1 upward against the separators 43 using a spring (not shown).

Sheet supply is performed as follows. A cam roller motor 49 (FIG. 4) rotates the cam roller 41 360° in the direction c. During the rotation, the larger, rounder arc 41*a* of the cam roller 41 frictionally drags the uppermost sheet P1 downward. The leading edge of the uppermost sheet P1 is separated from the sheet stack by the sheet separators 43. One rotation of the cam roller 41 brings the leading edge of the sheet P1 to a position slightly past the contact line of the feed roller 19 and the rear small roller 25*b*. A disk plate 51 is coaxial with the cam roller 41, and has a smooth peripheral surface and freely rotates on the axis, in order to prevent the trailing edge of the sheet from jamming the cam roller 41 when the sheet is fed back toward the cut-sheet supplier 11.

A sheet inlet 53 is formed in the rear panel of the body frame 1*a* and a sheet exit 55 is correspondingly formed in the supplier frame 37. Between the body frame 1*a* and the supplier frame 37 is a sheet insertion path 59, into which sheets of paper P2 are manually inserted one by one. The configuration of the sheet inlet 53 places the leading edge of the inserted sheet P2 between the feed roller 19 and the rear small roller 25*b*.

A separator 61 of a plastic film hangs down to cover the sheet exit 55. When a sheet P1 is supplied from the supplier 11, the separator 61 allows the sheet P1 into the body 1. But, when the sheet P1 is fed back from the body 1, the separator 61 guides it to the insertion path 59. Thus, sheets P1 from the supplier 11 and manually inserted sheets P2 are guided to the insertion path 59 when they are fed back from within the body frame 1*a*.

Below the sheet bed 11*a* is a sheet touch sensor 63 constructed of a sensor arm 64 and a photo-interrupter switch 65. When no sheet P1 is in a sheet path 57 of the supplier 11, the sensor arm 64 is set in the position shown by the solid line by means of a spring (not shown), whereby a lower end of the sensor arm 64 is detected by the photo-interrupter switch 65. When a sheet P1 is in the sheet path 57, the sheet P1 displaces the upper end of the sensor arm 64 (as shown by the chain line) and the photo-interrupter switch 65 fails to detect the lower end of the sensor arm 64, thus indirectly detecting the sheet P1.

One use of this touch sheet sensor 63 is for back-feeding of a sheet to the insertion path 59. When both the touch sensor 63 and the photo-sensor 35 detect the sheet, the sheet P1 is fed forward until the sensor 63 detects no sheet, then fed forward a predetermined distance, and then fed backward until the photo-sensor 35 detects no sheet.

The keyboard 7, as shown in FIG. 2, includes character and control keys 7*a*, numeral keys 7*b*, editing keys 7*c* and special control keys 7*d*. The special control keys 7*d* include an initial sheet-setting key 69 by which a sheet of paper P is placed at a predetermined initial printing position, i.e., a predetermined position at the top of the sheet P is brought to the printing position M.

Figure 4:
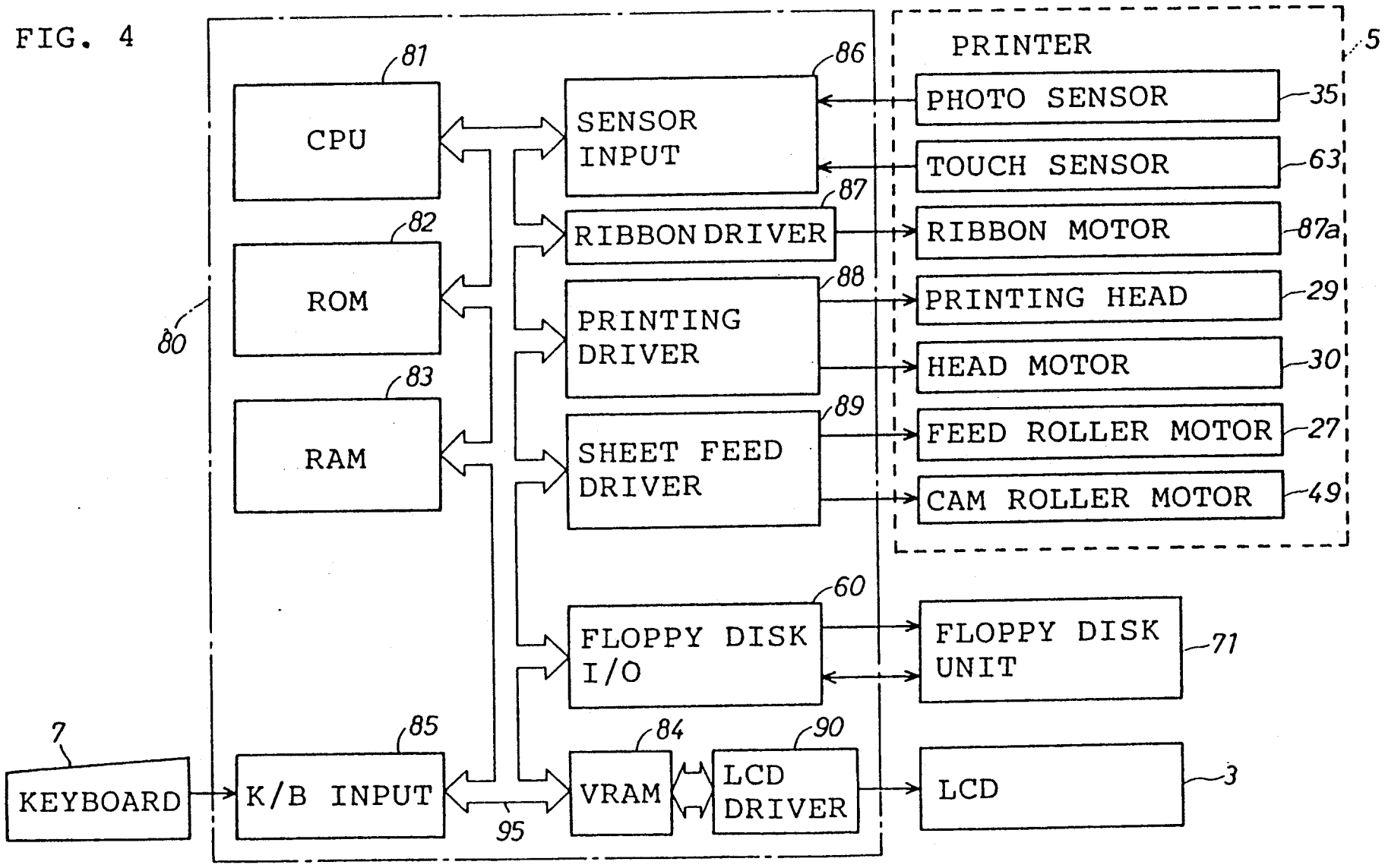
FIG. 4 is an electrical block diagram of a control section of the word processor.

The electrical system of the word processor is now explained with reference to FIG. 4. The central part of the system is a microcomputer 80 including a CPU 81, ROM 82, RAM 83, video-RAM (VRAM) 84 and input-/output (I/O) interfaces. The I/O interfaces include a sensor input interface 86 for the photo-sensor 35 and the touch sensor 63, a ribbon driver 87 for a ribbon feeding motor 87*a*, a printing driver 88 for the printing head 29 and the printing head motor 30, a sheet feed driver 89 for the feed roller motor 27 and the cam roller motor 49, a floppy disk I/O interface 60 for the floppy disk unit 71, an LCD driver for the LCD 3, and a keyboard input interface 85 for the keyboard 7. The VRAM 84 stores dot-matrix image data which is output to the LCD 3 by the LCD driver 90. The elements of the microcomputer 80 are connected by a bus 95.

Processes executed by the microcomputer 80, especially those relating to an initial sheet-setting operation, are explained with reference to FIG. 5. When the word processor is turned on, the CPU 81 executes an initialization at step S100, in which the memories, interfaces and peripheral equipment are initialized. Then, the CPU 81 waits for any key input at step S110. If any key is operated at step S110, it is determined at step S120 whether it is the initial sheet-setting key 69 or not. If the key is other than the initial sheet-setting key 69, the appropriate process, e.g., character inputting or text editing corresponding to the key pressed, is executed at step S130. If the key is the initial sheet-setting key 69, it is then determined at step S140 whether the photo-sensor 35 is ON. Here, one of the following situations obtains.

(A) There is no sheet at all in the sheet path 21, in the insertion path 59 or on the sheet bed 11*a*.

In this case, since the photo-sensor 35 is OFF, i.e., there is no sheet P at the photo-sensor 35, the feed roller motor 27 is started at step S150 to drive the feed roller 19 forward (direction a in FIG. 3). If there were any sheet P2 in the insertion path 59, it would be fed by the feed roller 19 toward the printing position M. Then, at step S160, it is again determined whether the photo-sensor 35 detects the sheet. Since no sheet is there in this case, it is again determined NO at step S160. Then it is determined at step S170 whether a predetermined time t1 has passed since the feed roller motor 27 is started at step S150. The time t1 is a function of the time interval necessary for a sheet in the insertion path 59 to come to the photo-sensor 35 at the normal speed of the feed roller 19. Steps S160 and S170 repeat until the time t1 passes then the cam roller 41 is rotated 360° at step S180. If there were a sheet P1 on the cut-sheet supplier 11, it would be fed by the feed roller 19 up to the printing position M. Then it is determined at step S190 whether the photo-sensor 35 detects the sheet P1. Since no sheet is detected in this case, it is further determined at step S200 whether another predetermined time t2 has passed since the cam roller 41 rotated at step S180. The time t2 is a function of the time interval necessary for a sheet P1 on the sheet bed 11*a* of the cut-sheet supplier 11 to come to the photo-sensor 35. Steps S190 and S200 are repeated until the time t2 passes: then the feed roller motor 27 is stopped at step S205 and an out-of-paper warning message prompting the operator to provide sheets P for the printer 5 is displayed on the LCD 3 at step S210. Then another key input is awaited at step S110.

(B) A sheet P2 is manually set in the insertion path 59.

In this case, the photo-sensor 35 detects the sheet P2 at step S160 within the time interval t1 after the feed roller is started at step S150. Therefore, at step S220, the sheet P2 is fed forward a predetermined distance d1 from the photo-sensor position, whereby the leading edge of the sheet P2 is positioned slightly above the printing position M.

(C) There is a sheet P1 on the cut-sheet supplier 11.

In this case, the photo-sensor 35 detects the sheet P1 at step S190 within the time interval t2 after the cam roller 41 rotates at step S180. Similarly as in case B above, the sheet P1 is then fed forward the predetermined distance d1 at step S220 to make the initial sheet-setting.

(D) A sheet P is already loaded in the sheet feeding mechanism F.

This case highlights the utility of the present invention. The sheet P is detected by the photo-sensor 35 at step S140 and by the touch sensor 63 at step S142 when the initial sheet-setting key 39 is sensed at steps S110 and S120. In this case, the feed roller 19 starts to be fed forward at step S144. Steps S144 and S146 are repeated until the touch sensor 63 is OFF, i.e. until the end of the sheet P passes the touch sensor 63. At step S148, the sheet is fed forward a predetermined distance d2 such that the end of the sheet can completely pass the separator 61. The feed roller 19 is stopped at step S149, and is then fed in the backward direction b in FIG. 3 at step S230 so that the end of the sheet P is introduced smoothly into the insertion path 59. Steps S230 and S240 are repeated until the photo-sensor 35 is OFF, i.e. until the leading edge of the sheet P passes the photo-sensor 35. The feed roller 19 is then stopped at step S245 and driven forward (direction a) at step S150. Since the photo-sensor 35 detects the sheet P within the time interval t1 at step S160, the leading edge of the sheet P is fed by the predetermined distance d1 from the photo-sensor 35 at step S220. Thus, even when the sheet P is already loaded in the sheet feeding mechanism F, the sheet P is not discharged from the printer 5 but the normal initial sheet-setting of the sheet P is performed. This allows manual realignment of a sheet loaded on the printing mechanism.

Obviously, many modifications and variations of the present invention are possible in light of the above teachings. It is therefore to be understood that within the scope of the appended claims, the invention may be practiced other than as specifically described.

What is claimed is:

1. A printer comprising:

sheet feeding means for feeding a sheet forward to and backward from a printing position;

a first sheet sensor, provided before the printing position, for detecting the sheet;

an initial sheet-setting controller, in response to the external initial sheet-setting command and the first sheet sensor's initial detection of no sheet, for driving the feeding means to feed the sheet forward a predetermined distance when the first sheet sensor first detects the sheet, and wherein said initial sheet-setting controller, in response to the external initial sheet-setting command and the first sheet sensor's initial detection of the sheet, drives the sheet feeding means to feed the sheet backward until the sheet sensor first detects no sheet and then to feed the sheet forward the predetermined distance;

a sheet supplier for holding, a plurality of separate sheets, and in response to a sheet-demanding command, for supplying one of the sheets to a printing section of the printer;

wherein the initial sheet-setting controller sends, in response to the initial sheet-setting command, the sheet-demanding command to the sheet supplier when the first sheet sensor detects no sheet, followed by feeding the sheet forward the predetermined distance after the first sheet sensor first detects the sheet;

said sheet supplier further includes a second sheet sensor at a sheet exit of the sheet supplier; and the initial sheet-setting controller drives the sheet feeding means, in response to the initial sheet-setting command and both the first sensor's and the second sensor's detection of the sheet, first forward until the second sheet sensor detects no sheet, then backward until the first sensor detects no sheet, and finally forward the predetermined distance.

2. A printer comprising:

sheet feeding means for feeding a sheet forward to and backward from a printing position;

a first sheet sensor, provided before the printing position, for detecting the sheet;

a first sheet supplier for holding a plurality of separate sheets, and, in response to a sheet-demanding command, for supplying one of the sheets to a printing section of the printer;

a second sheet sensor at a sheet exit of the first sheet supplier for detecting the sheet;

a separator provided at the sheet exit of the first sheet supplier for covering the sheet exit such that the sheet is not fed backward to the first sheet supplier;

a second sheet supplier adjacent to the first sheet supplier for providing the sheet to the printing section; and an initial sheet-setting controller for driving the sheet feeding means, in response to the external sheet setting command and detection of the sheet by the first sheet sensor and second sheet sensor, for driving the sheet feed means to feed the sheet forward until the second sheet sensor detects no sheet, then to feed the sheet forward a first predetermined distance, then to feed the sheet backward until the first sensor detects no sheet, and finally to feed the sheet forward by a second predetermined distance.

3. A printer according to claim 2, wherein the initial-setting controller includes:

driving means for driving the sheet feeding means, in response to the external sheet setting command and detection of no sheet by the first sheet sensor and second sheet sensor; and display means connected to the driving means for providing a sheet prompting message in response to further detection of no sheet by the first sheet sensor and second sheet sensor after a predetermined time interval has passed from a time point the first sensor detects no sheet.

4. A printer according to claim 2, wherein the second sheet supplier is a sheet insertion path along which a manually inserted sheet is guided to the printing section;

the initial sheet-setting controller includes;

first drive means for driving the sheet feeding means in response to the external sheet-setting command and detection of no sheet by the first sensor, and second drive means for driving the first sheet supplier in response to second detection of no sheet by the first sheet sensor and a predetermined time elapse after activation of the sheet feeding means.

5. A printer according to claim 4 wherein the initial sheet-setting controller includes:

display means connected to the second drive means for providing a sheet prompting message in response to third detection of no sheet by the first sensor and a predetermined time elapse after activation of the first sheet supplier.

6. A method of setting a leading edge of a sheet at a predetermined position succeeding a printing head position in a printer when the sheet is already loaded in the printer and detected by first and second sheet sensors, the method comprising the steps of:

feeding the sheet forward until no sheet is detected by the second sheet sensor, then feeding the sheet forward a first predetermined distance, and then feeding the sheet backward until no sheet is detected by the first sensor; and then feeding the sheet forward a second predetermined distance such that the leading edge of the second sheet reaches the predetermined position.

* * * * *